United States Patent [19]

Hyde

[11] Patent Number: 4,586,569

[45] Date of Patent: May 6, 1986

[54] RETRIEVABLE FLUID CONTROL VALVE

[75] Inventor: Walter E. Hyde, Duncan, Okla.

[73] Assignee: Halliburton Company, Duncan, Okla.

[21] Appl. No.: 656,065

[22] Filed: Sep. 28, 1984

[51] Int. Cl.[4] ..... E21B 34/08

[52] U.S. Cl. ..... 166/317; 137/529; 166/188; 166/322; 166/324; 166/325; 267/175; 267/177

[58] Field of Search ..... 166/321, 322, 324, 325, 166/317, 151, 149, 184, 131, 188; 137/269, 529, 530; 267/125, 177, 175, 169; 251/323, 337

[56] References Cited

U.S. PATENT DOCUMENTS

| | | | |
|---|---|---|---|
| 2,740,479 | 4/1956 | Schwegman | 166/145 |
| 2,854,929 | 10/1958 | McGowen, Jr. et al. | 166/188 |
| 2,888,080 | 5/1959 | Tausch et al. | 166/188 |
| 3,503,601 | 3/1970 | Wells | 267/169 |
| 3,754,568 | 8/1973 | Gallagher et al. | 267/175 X |
| 3,847,223 | 11/1974 | Scott et al. | 166/305 R |
| 4,133,516 | 1/1979 | Jürgens | 267/125 |
| 4,274,490 | 6/1981 | Huckaby | 166/325 |
| 4,399,871 | 8/1983 | Adkins et al. | 166/325 |

*Primary Examiner*—James A. Leppink
*Assistant Examiner*—Hoang C. Dang
*Attorney, Agent, or Firm*—E. Harrison Gilbert, III; James R. Duzan; Thomas R. Weaver

[57] ABSTRACT

An improved presettable, pressure-responsive retrievable fluid control valve contains a plurality of spring housing sections having individual springs disposed therein. Each of the springs is connected in mechanical parallel with each other spring. To select the preset pressure threshold at which the valve opens in response to a column of fluid in a tubing in which the valve is disposed, the number of springs and zero to two compression spacer members are chosen for each spring. The valve also includes a bypass section having an inner bypass mandrel connected by a frangible member to an outer bypass port member. Connected to the outer bypass port member is a sealing member for seating the valve in a seating nipple of a tubing. The bypass mandrel and the outer bypass port member are normally held by the frangible member in a fixed relationship so that ports through the bypass mandrel and the outer bypass port member are axially offset in a closed, or non-fluid conducting, position. When the valve is to be removed from the tubing, a force is applied to the bypass mandrel so that the frangible member is broken, thereby allowing relative movement between the bypass mandrel and the outer bypass port member. In this condition, the ports are aligned to allow a pressure equalizing fluid to flow on both sides of the sealing member so that the valve can be more easily retrieved from the seating nipple of the tubing.

5 Claims, 7 Drawing Figures

RETRIEVABLE FLUID CONTROL VALVE

BACKGROUND OF THE INVENTION

This invention relates generally to a valve for use in a tubing disposed in a bore hole and more particularly, but not by way of limitation, to a retrievable fluid control valve for controlling the flow of a column of fluid through a tubing and into the bore hole of an oil or gas well.

It is well known in the petroleum industry that there is a need for pumping fluids into a well and on into the formation into which the well is drilled. Such fluids are used for a variety of purposes, such as for scale removal, chemical treatments, and acidizing with jet tools on long open hole intervals or multiple sets of perforations. It is also known that such fluids are conducted into the formation through an open bore hole of the well into which a tubing has been placed for conducting the fluids.

Although many formations require the introduction of fluids for facilitating the drilling, completing or producing of a well, some formations cannot receive a continuous flow of fluids. Rather, such formations must intermittently receive the fluids. Therefore, there is the need for some type of device which can intermittently, rather than continuously, flow the fluids.

This need has been previously recognized as shown in U.S. Pat. No. 3,847,223, entitled "Retrievable Fluid Control Valve and Method" and issued Nov. 12, 1974. This patent discloses a valve, disposed in a tubing, which opens in response to the pressure of a column of fluid held by the valve reaching a predetermined magnitude. More particularly, this valve includes a single spring which provides a preset pressure threshold in response to the compression of a piston which is actuated in the bore hole by the hydrostatic head of the fluid column supported by the normally closed valve.

It is to be noted that the valve disclosed in U.S. Pat. No. 3,847,223 is not completely presettable at the surface, although a degree of surface presetting is achieved by means of the type of spring and the nature of the piston-retaining collar or external spacer rings used. Furthermore, this patent does not disclose a mechanism by which pressure on both sides of a seating nipple can be equalized for facilitating extraction of the valve from the tubing when the valve is closed. Additionally, this patent does not show a valve having a relatively wide range of different pressure threshold settings which are fully presettable at the surface. Because these features would enhance the utility of such a valve, there is the need for an improved retrievable fluid control valve which combines each of these features into a single device.

SUMMARY OF THE INVENTION

The present invention meets this need for an improved retrievable fluid control valve which can be fully preset at the surface within a relatively wide range of different pressure threshold settings and which incorporates a mechanism for facilitating the extraction of the valve from a tubing disposed in a bore hole into which fluid is to be flowed under control of the valve.

Broadly, the present invention provides a retrievable fluid control valve for controlling the flow of a fluid in a tubing in a well. The valve includes a valve housing, having an aperture defined therethrough for communicating the fluid in the tubing with a hollow interior of the valve housing, a valve seat associated with the valve housing, a valve member slidably disposed in the hollow interior for engaging the valve seat, a plurality of biasing means connected to the valve member for providing respective biasing forces tending to move the valve member against the valve seat, and coupling means for coupling each of the plurality of biasing means in mechanical parallel with each other. The valve further comprises a sealing member support means, a sealing member carried on the sealing member support means for forming a fluid-tight seal with the tubing, and bypass means connecting the sealing member support means with the valve housing for providing a channel through which the fluid in the tubing can flow on both sides of the seal formed by the sealing member so that the pressure acting on the sealing member is equalized, thereby facilitating disengagement of the sealing member from the tubing when the valve member is closed against the valve seat. Associated with the biasing means are internal spacer members which function as compression means for compressing the biasing means so that different preset pressure thresholds can be selected. Forming parts of the bypass means are an outer bypass port member and an inner bypass port member which are slidable relative to each other, but which are initially spatially fixed relative to each by a frangible means, such as a shear pin. These members have a stop means associated therewith for limiting the amount of relative movement between the two port members. Associated with the stop means is a shock absorber means for absorbing the shock when the stop means halts the movement between the two port members.

Therefore, from the foregoing, it is a general object of the present invention to provide a novel and improved retrievable fluid control valve. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

With reference to the drawings, the preferred embodiment of a retrievable fluid control valve 2 constructed in accordance with the present invention will be described. The valve 2 is responsive to the pressure exerted by a column of fluid supported by the valve 2 in a tubing 3 (see FIG. 2) which is disposed in an open bore hole 5 (see FIG. 2) drilled in a formation into which the column of fluid is to be flowed.

The valve 2 includes an elongated housing 4 (see FIG. 2) having a plurality of sections and other elements contained therein as will be subsequently described hereinbelow.

Figure 1A:
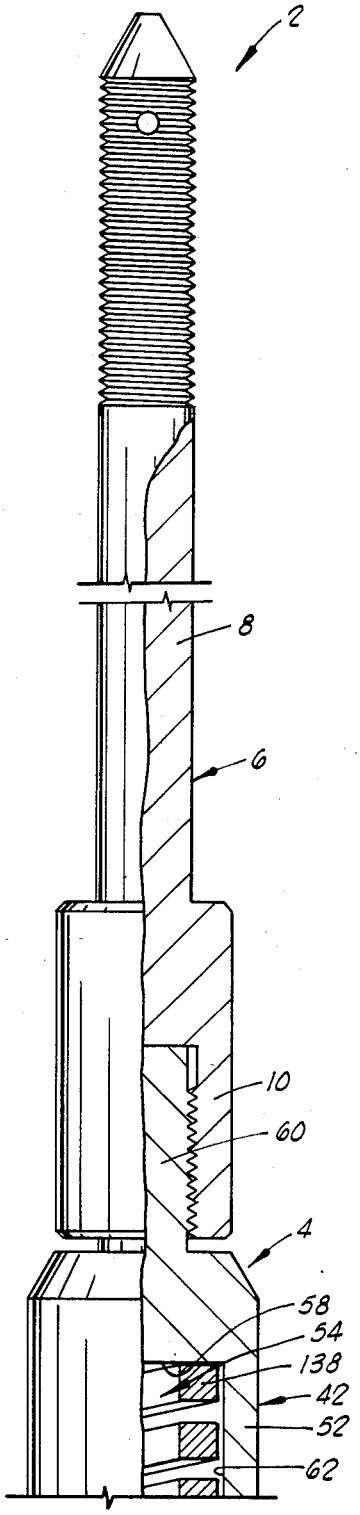
FIGS. 1A–1F form a partial sectional view of the preferred embodiment of the present invention.

As shown in FIG. 1A, threadedly attached to one end of the elongated housing 4 is a fishing member 6 having a cylindrical neck portion 8 formed with a cylindrical, internally threaded hub portion 10 having a larger outer diameter than the neck portion 8. The fishing member 6 enables the valve 2 to be installed in and extracted from the tubing by means of a wire line or sand line and overshot (not shown) as known to the art.

Connected to the other end of the elongated housing 4 is a bypass means 12 (see FIGS. 1E, 1F and 2) which is to be described more fully hereinbelow.

Connected to the end of the bypass means 12 opposite the elongated housing 4 is a sealing means 14 (see FIGS. 1F and 2) for holding the valve 2 in a seating nipple 7 within the tubing 3 in a manner as known to the art. As shown in FIG. 1F, the sealing means 14 includes a sealing member support means comprising a substantially cylindrical sealing shoe 16 having a fluid passageway 18 defined therethrough. The sealing shoe 16 has an externally threaded throat or neck portion 20 which is radially inwardly and radially outwardly offset from the outer and inner surfaces, respectively, of the main body of the sealing shoe 16. This construction defines an outer threaded surface 22 having a diameter which is less than the diameter of an outer surface 24 of the main body of the sealing shoe 16 and further defines a surface 26 having a greater diameter than the diameter of an inner surface 28 of the main body of the sealing shoe 16. The surfaces 22 and 24 are interconnected by a radial wall 30, and the surfaces 26 and 28 are connected by a radial wall 32. The surface 26 defines a cylindrical recess. Defined within the opposite end of the sealing shoe 16 is a threaded cavity having a surface 34 with a diameter greater than the diameter of the surface 28. The surface 34 is connected to the surface 28 by a radial surface 36. Retained by the threaded surface 34 and forming another part of the sealing member support means is a sealing member mandrel and retainer member 38 which has a fluid passageway 39 defined therethrough in communication with the fluid passageway 18. Disposed on the member 38 is an annular sealing member 40. The sealing member 40 is of a suitable type as known to the art for providing a fluid-tight seal with the tubing 3 to prevent the column of fluid retained by the valve 2 in its closed state from flowing past the exterior of the sealing means 14 between the sealing member 40 and the tubing. So that a choke of a suitable type as known to the art can be added to the valve 2, the sealing means 14 terminates in a retainer nose member 41 threadedly connected to the sealing member mandrel and retainer member 38 so that fluid flowing through the passageway 39 passes through the hollow interior of the member 41.

Figure 1B:
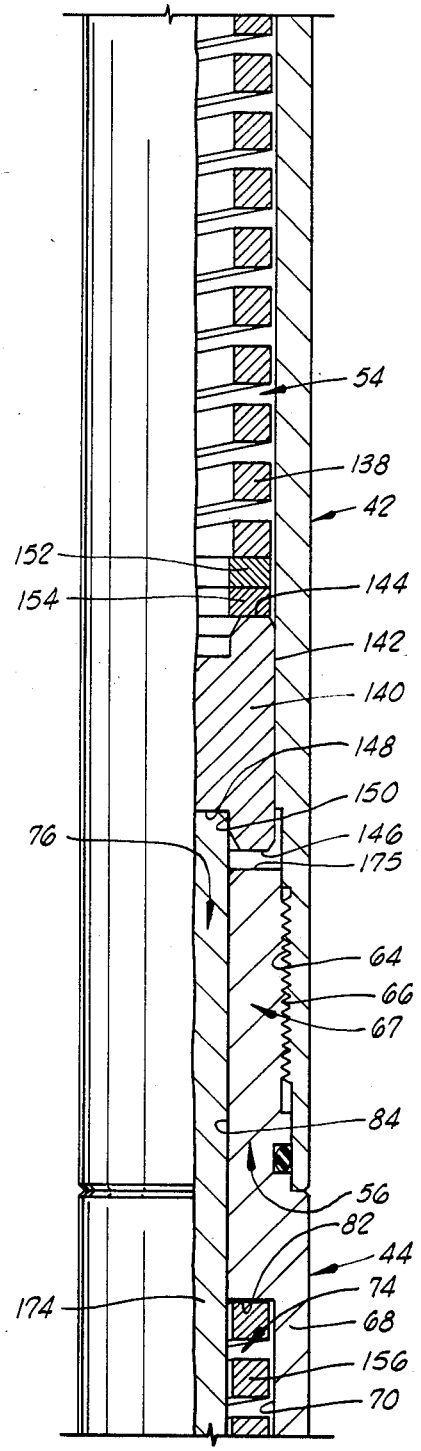
Figure 1C:
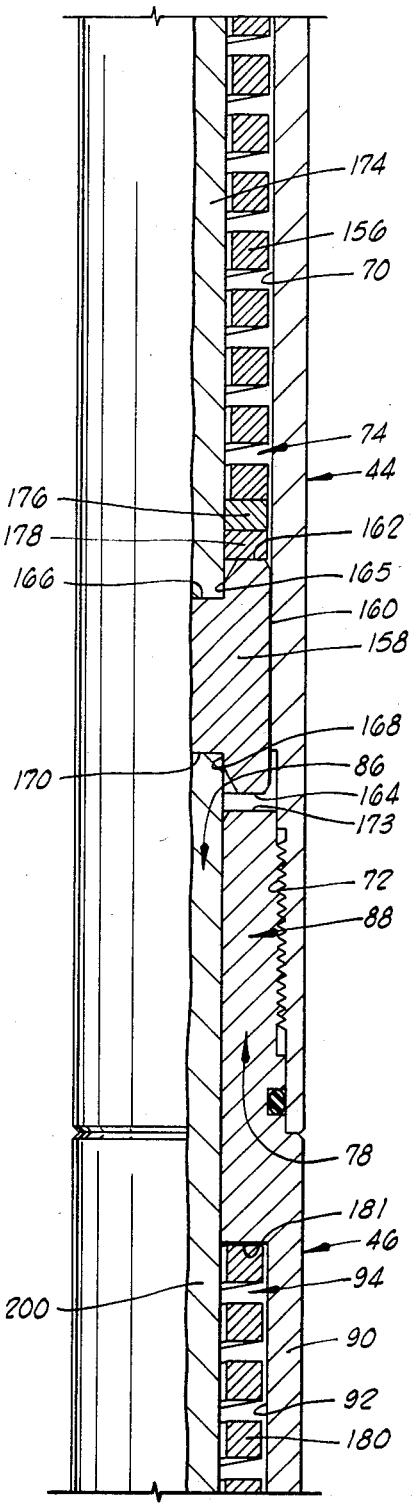
Figure 1D:
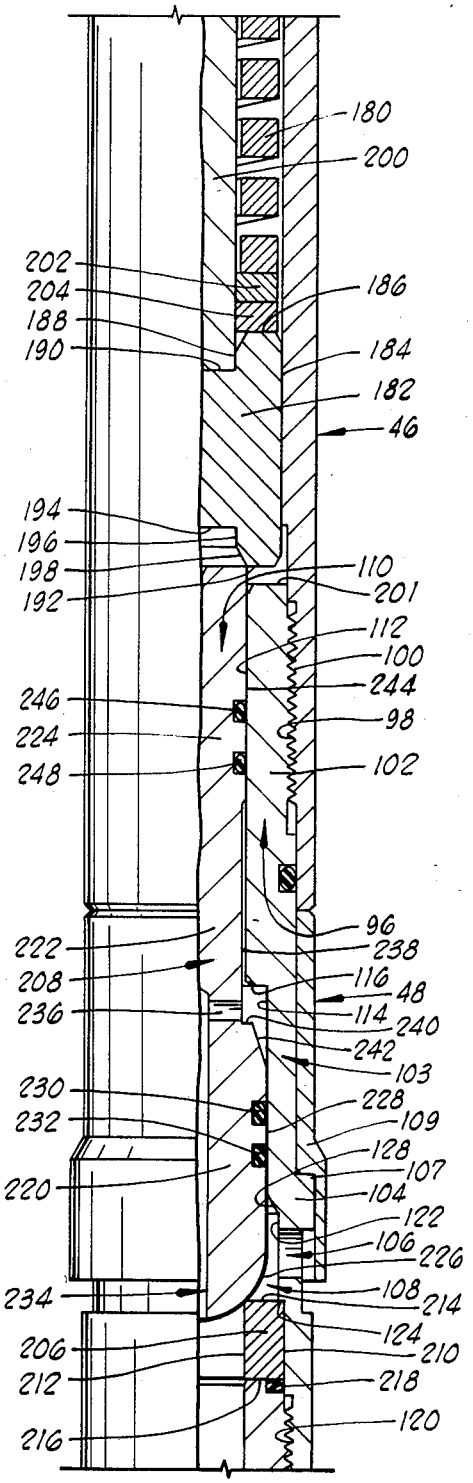
Figure 1E:
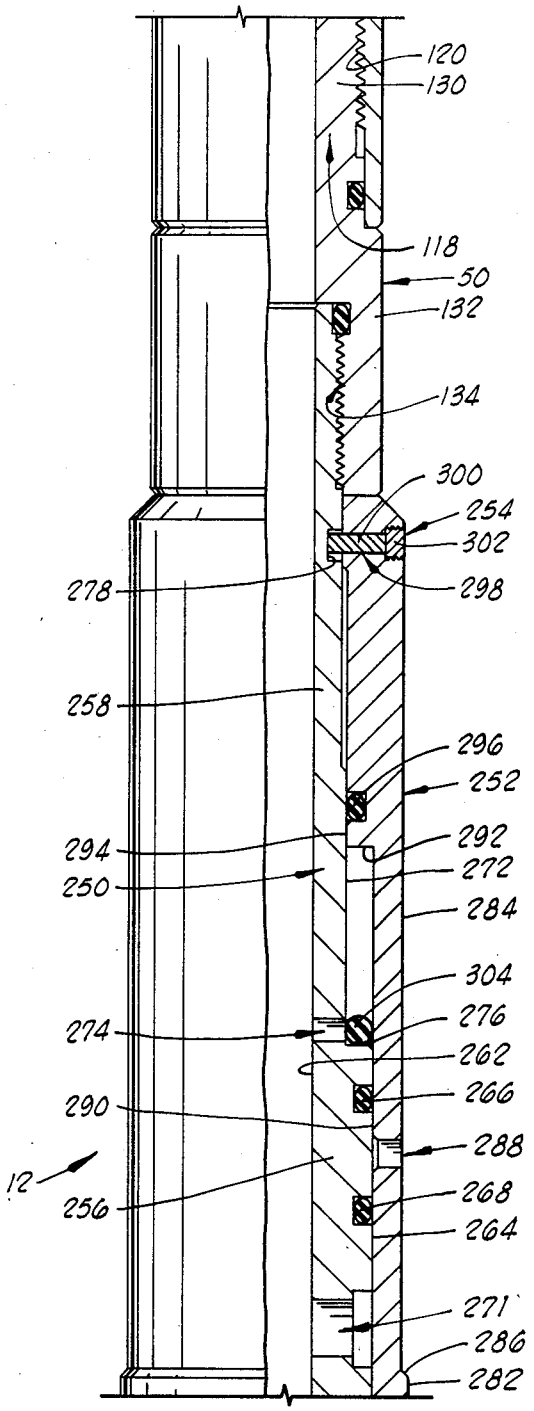
Figure 1F:
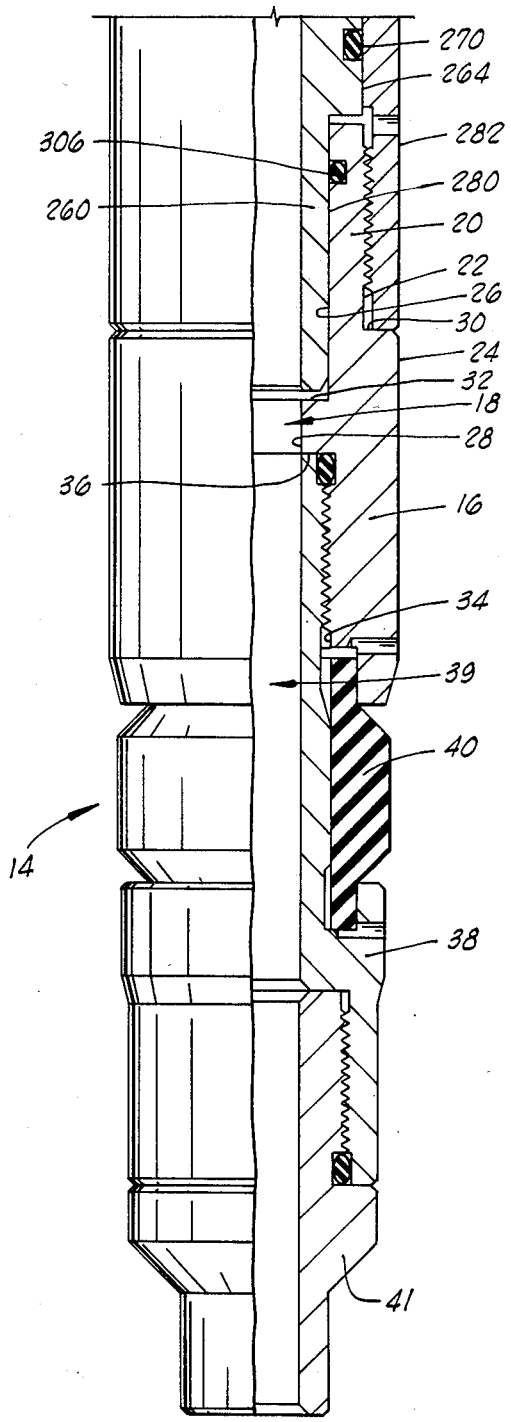

To more particularly describe the housing 4, reference is made to FIGS. 1A–1E. These drawings show the elongated housing 4 including a first spring section 42 (FIGS. 1A–1B), a second spring section 44 (FIGS. 1B–1C), a third spring section 46 (FIGS. 1C–1D), a valve section 48 (1D–1E), and an outlet 50 (FIG. 1E).

The first spring section 42 is constructed in the preferred embodiment as a cylindrical spring housing member 52 having a cavity 54 with only a single opening 56 defined therein. The end of the cavity 54 opposite the opening 56 is closed by a radial end wall 58 of the housing member 52. Extending axially or longitudinally in one direction from the end wall 58 is an externally threaded stub or protuberance 60 which threadedly couples with the hub 10 of the fishing member 6. Extending in an opposite direction from the radial end wall 58 is an axial side wall 62. The side wall 62 terminates at the opening 56 with an internally threaded surface 64.

The internally threaded surface 64 engages an externally threaded surface 66 of a neck portion 67 of the second spring section 44 which in the preferred embodiment includes a substantially cylindrical spring housing member 68 having an axial side wall 70 extending from the neck portion 67 to an opposite end having an internally threaded surface 72. A cavity 74 with two openings 76, 78 is defined by the axial side wall 70 and by a radial end wall 82. Extending axially from the radial end wall 82 through the neck portion 67 is an axial surface 84 which defines the opening 76. The opening 78 is defined through the threaded surface 72 end at the mouth of the axial side wall 70 opposite the radial end wall 82.

The opening 78 communicates with an opening 86 defined through a neck portion 88 of a cylindrical spring housing member 90 forming the third spring section 46. The spring housing member 90 includes an axial side wall 92 extending from the neck portion 88 to define a cavity 94 similar to the cavity 74 of the second spring section 44. The cavity 94 has the reduced diameter opening 86, which is similar in shape to the opening 76 of the second spring section 44, and it has a longitudinally opposite opening 96, which is similar to the wider diameter opening 78 of the second spring section 44. The opening 96 is defined through the end of the axial side wall 92 which has a threaded surface 98 defined on the interior surface thereof.

The threaded surface 98 connects with an externally threaded surface 100 of a neck portion 102 of the valve section 48 which has a valve body or valve housing member 103 defined by the neck portion 102 and an axial main port side wall 104 through which a radial aperture 106 is defined. The radial aperture 106 is defined through the valve housing 103 adjacent a flange 107 thereof extending radially outwardly. The flange 107 retains a filter ring member 109 thereon. The filter ring member 109 has a cylindrical body from which a cylindrical skirt extends. The skirt overlies, but is spaced radially outwardly from, the radial aperture 106. The radial aperture 106 is one of three openings into an interior cavity 108 defined within the valve body 103. The cavity 108 has another opening 110 defined through the neck portion 102. The opening 110 is defined by an interior surface 112 which is radially inwardly spaced from an interior surface 114 of the valve body 103 by a radial wall 116. Opposite the opening 110 is still another opening 118 to the cavity 108. The opening 118 is defined through an interior threaded surface 120 of the side wall 104. The surface 120 defines one of four levels of interior surfaces of the side wall 104. The surface 120 is the level with the greatest diameter, and it is connected to another interior surface 122 by means of a radial wall 124. The surface 122 intersects the aperture 106. The surface 122 is connected to the surface 114 which is the third level and which has the smallest diameter of the three surfaces 120, 122, 114. The surface 122 connects with the surface 114 by means of a tapered wall 128. The fourth level, and the one with the smallest diameter of the four, is defined by the surface 112.

Completing the construction of the preferred embodiment of the elongated housing 4 is the outlet 50 which is defined by a valve seat retainer member or adapter having an externally threaded neck portion 130 connected to the threaded surface 120 of the valve section 48. Extending radially outwardly from the neck portion 130 is a hub portion 132 having a threaded recess 134 which threadedly connects with the bypass means 12. The outlet 50 has a fluid passageway defined through the neck and hub portions for communicating the cavity 108 of the valve section 48 with a fluid passageway defined through the bypass means 12.

The outer diameters of each of the sections 42–50 are substantially equal (except for the skirt of the filter ring 109 which is slightly offset) so that the elongated housing 4 generally has a linear, cylindrical outer appearance in the preferred embodiment when the sections are coaxially connected as shown in the drawings. These sections are connected in a fluid-tight engagement by various sealing members of types as known to the art, such as by the O-rings illustrated in the drawings.

Contained within these various sections of the elongated housing 4 are several additional elements of the valve 2 of the present invention. In the cavity 54 of the first spring section 42 there is disposed a compression spring 138 having one end retained against the end wall 58 and having its other end extending longitudinally or axially through the cavity 54 toward the opening 56. The spring 138 is of a suitable construction as known to the art for providing a biasing force of a sufficient magnitude to form a part of the preset pressure threshold against which the column of fluid in the tubing 3 is to act. In the description of the operation of the present invention set forth hereinbelow, there is a chart exemplifying pressure thresholds which can be selected in the preferred embodiment.

The spring 138 is held in the cavity 54 by a cylindrical spring guide member 140. The spring guide member 140 has a cylindrical outer surface 142 which intersects at one end a radial annular surface 144 adjacent the spring 138 and which intersects at its opposite end a radial surface 146. The radial surface 146 has an annular shape which extends around an opening into a recess defined by a radial surface 148 and a circumferential axial surface 150. The surface 150 intersects the surfaces 146, 148.

To adjust the biasing force exerted by the spring 138, a compression means comprising in the preferred embodiment one or two spacer members 152, 154 can be used. Each spacer member 152, 154 has an annular shape and is positioned, when used, between the radial surface 144 and the adjacent end of the spring 138 as shown in FIG. 1B. When one or both of the spacer members 152, 154 is used, it is used entirely internally of the elongated housing 4.

The second spring section 44 includes elements similar to those disposed in the first spring section 42. In particular, the second spring section 44 has a compression spring 156 disposed in the cavity 74 so that one end of the spring 156 abuts the end wall 82 and the other end of the spring 156 extends axially toward the opening 78. Retaining this other end of the spring 156 is a spring guide member 158 having an outer cylindrical surface 160 which extends between a radial annular surface 162 and a radial annular surface 164. The annular surface 162 has an interior edge which opens into a recess defined by a circumferential surface 165 interiorly terminated at the bottom of the recess by a radial surface 166. The annular surface 164 has an inner edge which defines an opening into a recess defined by a cylindrical axial surface 168 extending longitudinally to a radial surface 170.

The spring 156 is concentrically mounted on a spring mandrel or push rod 174 which provides a cylindrical coupling member extending between the spring guide member 140 and the spring guide member 158. One end of the rod 174 is received in the recess defined by the surfaces 148, 150 and the opposite end of the rod 174 is received in the recess defined by the surfaces 165, 166. This construction couples the springs 138, 156 in mechanically operational parallel. The rod 174 extends axially through the cavity 74 and the opening 76 defined by the surface 84. As shown in FIG. 1B, the outer diameter of the rod 174 and the diameter of the surface 84 are approximately equal although the diameter of the surface 84 is slightly larger so that the rod 174 is slidingly received thereby. The length of the rod 174 is selected so that when the radial surface 164 of the spring guide member 158 abuts an end surface 173 of the third spring housing member 90, the radial surface 146 of the spring guide member 140 abuts an end surface 175 of the second spring housing member 68.

In the spring housing member 68, there can also be contained a compression means comprising, in the preferred embodiment, one or two annular spacer members 176, 178 which provide a compression of the spring 156 in a manner similar to the spacer members 152, 154 which can act on the spring 138. The effect of the use or non-use of either or both of these spacer members 176, 178 in the preferred embodiment is shown in the chart set forth hereinbelow with reference to the operation of the present invention. The spacer members 176, 178 are concentrically mounted on the rod 174 between the annular surface 162 and the adjacent end of the spring 156.

The third spring section 46 has disposed therein elements which are similar to those disposed within the second spring section 44. In particular, these elements include a compression spring 180 having one end abutting a radial end wall 181 of the cavity 94 and having its other end extending axially toward the opening 96. The spring 180 is retained in the cavity 94 by a spring guide member 182. The guide member 182 has an outer cylindrical surface 184 terminating at one end in a radial annular surface 186 disposed at the mouth of a recess defined by an axial circumferential surface 188 and a radial surface 190. The surface 184 terminates at its other end in a radial annular surface 192 extending inwardly to the mouth of a recess defined by a radial surface 194 and a circumferential axial surface 196. As with the other circumferential axial surfaces of the recesses in the guide members of the preferred embodiment, the surface 196 includes a tapered portion 198.

The recess defined by the surfaces 188, 190 receives one end of a push rod or spring mandrel 200 having the spring 180 concentrically mounted thereon. The other end of the rod 200 is received in the recess defined by the surfaces 168, 170 of the spring guide member 158 in the second spring section 44. The rod 200 is cylindrical and passes slidingly through the opening 86 in the neck portion 88 of the housing member 90; therefore, the diameter of the opening 86 is slightly larger than the outer diameter of the rod 200. The rod 200 has a length which enables the annular surface 164 to abut the end surface 173 of the housing member 90 when the annular surface 192 abuts an end surface 201 of the valve housing 103. The rod 200 and the guide members 158, 182 couple the spring 180 in mechanical parallel with the spring 156 which is in turn connected in mechanical parallel with the spring 138.

Other elements shown contained within the third spring section 46 include up to two annular spacer members 202, 204 which are concentrically received on the rod 200 between the radial annular surface 186 and the adjacent end of the spring 180 for selectively compressing the spring 180.

Considering now the contents of the valve housing 103, FIG. 1D shows that these elements include a valve seat 206 and a valve member or stem 208. The valve seat 206 is an annular member having a cylindrical axially extending outer surface 210 received adjacent an unthreaded portion of the surface 120. The valve seat 206 also has an inner cylindrical axially extending surface 212 which defines an opening or aperture through which fluid can flow. Two radial annular surfaces 214, 216 extend between the inner and outer surfaces 212, 210, respectively. The annular valve seat 206 is retained adjacent the surface 120 and the radial surface 124 by means of the valve seat retainer member, defining the outlet 50, and an O-ring 218. In the preferred embodiment, the valve seat 206 is made of tungsten carbide.

The valve member 208 is, in the preferred embodiment, a unitary tungsten carbide structure having a head portion 220, a medial portion 222, and a tail portion 224. The head portion 220 has a spherical forward edge 226 which engages the valve seat 206 at the intersection of the inner surface 212 and the radial surface 214 when the valve member 208 is in its closed position. Extending straight back from the rear end of the edge surface 226 is a cylindrical outer surface 228 having two circumferential grooves defined therein for receiving sealing members 230, 232 which fluid-tightly engage the surface 114 of the valve body 103. A cavity 234 is defined axially through the head portion 220 of the valve member 208.

The end of the cavity 234 is defined in the medial portion 222 which has a radial aperture 236 extending from the cavity 234 to an outer surface 238 of the medial portion 222. The outer surface 238 is connected to the outer surface 228 of the head portion by means of a radial wall 240 and a tapered wall 242. The diameter of the outer surface 238 is less than the diameter of the outer surface 228. The diameter of the outer surface 238 is also less than the diameter of the surface 112 of the valve body 103 so that an annular space is defined therebetween. This annular space communicates with an adjacent space defined by the surfaces 114, 116 of the valve body 103 and the surfaces 240, 242 and a portion of the surface 238 of the valve member 208. The aperture 236 opens into this space.

Extending to the rear of the medial portion 222 is the tail portion 224 having an outer cylindrical surface 244 which has a diameter larger than the diameter of the surface 238 and approximately equal to the diameter of the surface 112, except that there is a tolerance between the surface 244 and the surface 112 so that the valve member 208 is slidably disposed within the valve body 103. The wall 244 has two grooves defined therein for receiving sealing members 246, 248 for forming a fluid-tight seal with the surface 112. The tail portion 224 terminates in an end which is received in the recess defined by the surface 192 of the spring guide member 182.

The valve member 208 is movable within the cavity 108 of the valve body 103 between the aforementioned closed position, wherein the spherical edge portion 226 engages the valve seat 206, and an open position, wherein the spherical edge portion 226 is spaced from the valve seat 206 to allow fluid communication between the aperture 106 and the aperture defined through the annular valve seat 206. The maximum open position of the valve member 208 causes the radial surface 240 to abut the radial surface 116 to thereby provide a stop means for the open movement of the valve member 208 relative to the valve body 103.

Connected at the outlet 50 of the elongated housing 4 is the bypass means 12, the preferred embodiment of which is shown in FIGS. 1E–1F. The bypass means 12 of the preferred embodiment includes an inner bypass port member or bypass mandrel 250 which is slidably related in concentric disposition with an outer bypass port member 252. The two members 250, 252 are retained in a fixed spatial relation relative to each other by means of a retainer mechanism 254.

The inner bypass port member 250 has a main body portion 256 disposed between end portions 258, 260. Each of these three portions has a common interior surface 262 which defines a cylindrical fluid passageway or cavity through the entire length of the inner bypass port member 250.

The main body portion 256 has an outer cylindrical surface 264 in which three spaced grooves are circumferentially defined for receiving sealing members 266, 268, 270. Defined through the section 256 between the sealing members 268, 270 is a radial port or opening 271 intersecting the inner surface 262 and the outer surface 264. The outer surface 264 has a diameter which is sufficient to allow fluid-tight engagement between the sealing members 266, 268, 270 with the outer bypass port member 252, but also sufficient to allow the relative slidable movement between the two members 250, 252.

The end portion 258 of the inner member 250 has an outer surface 272 with a diameter which is smaller than the diameter of the outer surface 264. The end portion 258 includes a radial aperture 274 extending therethrough in communication with the surface 272 and the surface 262. The surface 272 is spaced from the surface 264 by a radial surface 276. Defined in the surface 272 is a circumferential recess 278 for receiving an end of the retainer member 254. The surface 272 terminates in a threaded portion which engages the internally threaded portion 134 of the outlet 50.

The end portion 260 has an outer surface 280 having a diameter which is smaller than the diameters of both the surface 264 and the surface 272. The end portion 260 is slidingly received in the cylindrical recess defined by the surface 26 of the sealing shoe 16. A sealing member 306 is disposed in a circumferential groove defined in the surface 26.

The end portion 258 and the end portion 260 terminate in respective openings for providing fluid communication between the elongated housing 4 and the sealing means 14.

The outer bypass port member 252 has a substantially cylindrical configuration with a hub end having an outer surface 282 extending slightly radially farther outward than a cylindrical port surface 284 which is connected to the surface 282 by a tapered surface 286. The hub portion with the surface 282 also has an internal surface which is threaded for coupling with the externally threaded surface 22 of the sealing shoe 16.

The port surface 284 intersects at least one port or opening 288. The port 288 extends radially through the side wall of the outer bypass port member 252 until it intersects with an inner cylindrical surface 290. The surface 290 terminates at one end in a radial surface 292 which extends radially inwardly from the surface 290 until it intersects a circumferential axial surface 294. The axial surface 294 has a groove defined therein for receiving a sealing member 296 which fluid-tightly seals with the outer surface 272 of the inner bypass port member 250. Extending between the surface 284 and the surface 294 is a threaded countersunk aperture 298 for receiving the retainer member 254.

. The retainer member 254 includes, in the preferred embodiment, a frangible shear pin 300 which is held by a set screw 302. When the shear pin 300 is properly placed in the countersunk aperture 298, one end of the pin 300 extends into the circumferential groove 278 to hold the inner member 250 and the outer member 252 in relatively fixed relationship. This defines a closed position wherein the port 288 is positioned between the sealing members 266, 268 to prevent fluid flow through the port 288 to the port 271. In this position the port 288 is axially spaced from the port 271. Also in this position, the radial wall 276 is spaced from the radial wall 292 so that an open space or chamber is defined therebetween. The shear pin 300 has what will be called a release force rating indicating that when some predetermined force acting longitudinally or axially relative to the valve 2 and thus transversely relative to the length of the shear pin 300 is applied to the shear pin 300 (as determined by the nature of the pin 300 as known to the art), the end of the shear pin 300 received in the groove 278 will be sheared from the remainder of the pin 300 held in the opening 298. When the shear pin 300 is so broken, relative movement between the inner member 250 and the outer member 252 can occur. During such relative movement, the radial surface 276 will be brought nearer to the radial surface 292 and the port 271 will be brought nearer to the port 288. When the port 271 aligns with the port 288 in fluid communication, the bypass means is said to be in an open condition whereby fluid within the tubing externally of the valve 2 and above the sealing member 40 can flow into the bypass means 12 and through the sealing means 14 to equalize pressure on both sides of the sealing member 40.

To insure the proper alignment of the ports 271, 288, the radial surface 276 and the radial surface 292 provide overlapping shoulder portions which function as a stop means to stop the relative movement between the inner and outer members 250, 252. To absorb some of the shock from the stopping action of the surfaces 276, 292, the present invention includes a shock absorbing means comprising an annular resilient member 304 disposed in the space between the surfaces 276, 292.

Operationally, the pressure thresholds at which the valve member 208 is to open and close are set by using anywhere from one to all three of the springs 138, 156, 180 and from zero to all six of the spacer members 152, 154, 176, 178, 202, 204. The following table shows approximate or estimated operating pressures of the illustrated embodiment for the tabulated combinations of springs and 3/16-inch spacer members:

| SPRINGS | 3/16-inch SPACERS | PRESSURE (PSI) Open | Close |
|---|---|---|---|
| 1 | 0 | 1700 | 1500 |
| | 1 | 2300 | 2100 |
| | 2 | 2800 | 2600 |
| 2 | 0 | 3500 | 3000 |
| | 1 | 4100 | 3600 |
| | 2 | 4600 | 4100 |
| | 3 | 5100 | 4500 |
| | 4 | 5600 | 4900 |
| 3 | 0 | 5400 | 4700 |
| | 1 | 5900 | 5400 |
| | 2 | 6500 | 5800 |
| | 3 | 7100 | 6400 |

-continued

| SPRINGS | 3/16-inch SPACERS | PRESSURE (PSI) Open | Close |
|---|---|---|---|
| | 4 | 7500 | 6600 |
| | 5 | 7900 | 6800 |
| | 6 | 8300 | 7100 |

As indicated by the foregoing table, when a spacer member is used, it compresses the respective spring independently of the operation of the valve member 208 (which acts to compress the springs in response to the pressure of the fluid column acting on the valve member 208) and independently of other spacer members to increase the pressure thresholds. In selecting the elements to preset the valve 2, the preset opening pressure threshold selected should be at least 15% higher than the calculated hydrostatic pressure of a full column of fluid inside the tubing at the depth the valve 2 is to be set.

Figure 2:
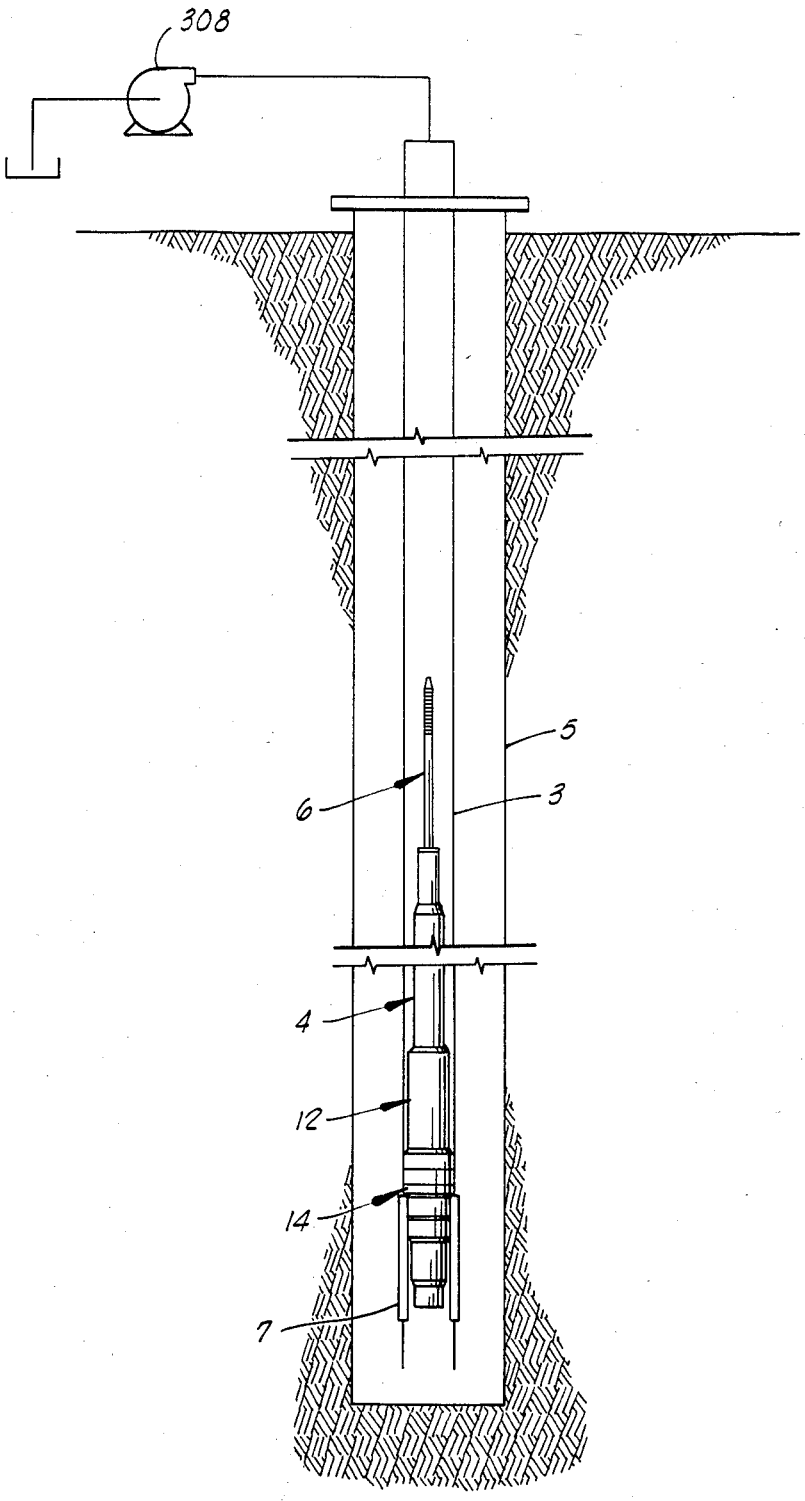
FIG. 2 is a schematic drawing illustrating the present invention disposed in a tubing in a bore hole.

Once the valve 2 has been preset at the surface by selecting the required number of springs and spacers, it is dropped or lowered into the tubing 3 until the sealing member 40 is properly receiving in the seating nipple 7 of the tubing 3 as schematically illustrated in FIG. 2 and as known to the art. In this position, the valve mechanism provided by the bypass means 12 is closed because the frangible shear pin 300 is secured in its integral form between the inner bypass port member 250 and the outer bypass port member 252. The valve member 208 is likewise in its closed position adjacent the valve seat 206 because the pressure in the tubing is initially less than the preset opening pressure threshold exerted on the valve member 208 by the parallel-connected springs 138, 156, 180.

With the valve 2 properly seated in the seating nipple of the tubing, the fluid is flowed into the tubing and pressurized, such as by a pump 308 illustrated in FIG. 2, until the pressure of the column of fluid exceeds the preset opening pressure threshold of the parallel-connected springs. This pressure of the fluid column acts on the differential area defined between the diameter of the surface 228 of the valve member 208 and the diameter defined at the point of abutment between the spherical shoulder portion 226 of the valve member 208 and the valve seat 206.

Any pressure existing below the installed valve 2 has no effect on the preset pressure thresholds because such pressure acts in both a valve-open and a valve-closed direction by means of the cavity 234, the aperture 236 and the differential surface area of the space into which the aperture 236 opens.

When the pressure of the fluid column in the tubing exceeds the preset opening threshold pressure, the valve member 208 is moved to its open position so that the column of fluid flows through the port 106, through the opening in the valve seat 206, and on down through the fluid passageways of the outlet 50, the inner bypass port member 250, and the sealing means 14. When the valve member 208 is moved to its open position, the filter ring 109 disposed adjacent the aperture 106 assists in filtering solid material within the fluid column by requiring the fluid to flow in a circuitous path down the tubing, around the filter ring 109 and into the aperture 106 in a manner as known to the art.

When the hydrostatic pressure from the fluid column is reduced to below the preset closing threshold pressure, the valve member 208 returns to its closed position adjacent the valve seat 206. The closed valve will then hold the column of fluid in the tubing regardless of the pressure below the closed valve.

To remove the valve 2 from the tubing, a wire line or sand line and overshot are attached to the fishing neck 8. The line is pulled with a sufficient force to break the pin 300. When the pin 300 is broken, continued pulling on the wire line or sand line moves the inner bypass port member 250 relative to the outer bypass port member 252 which is securely retained to the tubing by means of the sealing member 40. When the ports 271, 288 become aligned through this continual pulling, fluid from the fluid column flows into the bore hole to equalize the pressure on both sides of the sealing member 40. Still further pulling of the wire line or sand line extracts the entire valve assembly from the tubing because the radial wall 276 of the inner bypass port member 250 and the shock absorber means 304 engage the radial surface 292 of the outer bypass port member 252 to pull the outer bypass port member 252 and the sealing means 14 to the surface with the remainder of the valve assembly of the present invention.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A retrievable fluid control valve, comprising:

a first cylindrical spring housing member having a first cavity with only one opening thereto defined therein;

first spring means, disposed in said first cavity, for providing a first biasing force;

a first spring guide member disposed coaxially with said first spring means between said first spring means and said one opening of said first cavity;

a second cylindrical spring housing member having a second cavity with two openings thereto defined therein, said second spring housing member coaxially connected to said first spring housing member with said first cavity communicating with said second cavity through the only opening to said first cavity and one of said two openings to said second cavity;

second spring means, disposed in said second cavity, for providing a second biasing force;

a second spring guide member disposed coaxially with said second spring means between said second spring means and the other one of said two openings to said second cavity;

a first coupling member extending between said first and second spring guide members and having said second spring means mounted thereon;

a third cylindrical spring housing member having a third cavity with two openings thereto defined therein, said third spring housing member coaxially connected to said second spring housing member with said second cavity communicating with said third cavity through the other one of said two openings to said second cavity and one of the two openings to said third cavity;

third spring means, disposed in said third cavity, for providing a third biasing force;

a third spring guide member disposed coaxially with said third spring means between said third spring means and the other one of said two openings to said third cavity;

a second coupling member extending between said second and third spring guide members and having said third spring means mounted thereon;

a valve housing member having a fourth cavity with three openings thereto defined therein, said valve housing member coaxially connected to said third spring housing member with said third cavity communicating with said fourth cavity through the other one of said two openings to said third cavity and a first one of said three openings to said fourth cavity;

a valve seat retained in said fourth cavity between a second one and a third one of said three openings to said fourth cavity;

a valve member slidably disposed in said fourth cavity in engagement with said third spring guide member so that said valve member is urged toward a closed position against said valve seat by said first, second and third biasing forces wherein said valve member obstructs fluid flow between said second one and said third one of said three openings to said fourth cavity and so that said valve member is urged toward an open position away from said valve seat by an external force acting against said first, second and third biasing forces wherein said valve member is removed from obstructing fluid flow between said second one and third one of said three openings to said fourth cavity;

a cylindrical bypass mandrel having a fifth cavity with three openings thereto defined therein, said bypass mandrel coaxially connected to said valve housing member with said fourth cavity communicating with said fifth cavity through the third one of said three openings to said fourth cavity and a first one of said three openings to said fifth cavity;

an outer bypass port member having a sixth cavity with three openings thereto defined therein, said outer bypass port member having said bypass mandrel concentrically disposed therethrough with the first one and a second one of the openings to said fifth cavity coaxially aligned with a first one and a second one of said three openings to said sixth cavity and with a third one of the three openings to said fifth cavity radially spaced from a third one of the three openings to said sixth cavity; and shear pin means for connecting said outer bypass port member to said bypass mandrel so that the third one of said three openings to said fifth cavity is longitudinally spaced from the third one of said three openings to said sixth cavity, said shear pin means responsive to a longitudinal force applied to said bypass mandrel for breaking said shear pin means so that said bypass mandrel is movable relative to said outer bypass port member to an open bypass position wherein the third one of said three openings to said fifth cavity is aligned with the third one of said three openings to said sixth cavity.

2. The retrievable fluid control valve of claim 1, wherein:

said bypass mandrel has an outer surface from which a first shoulder portion radially outwardly extends;

said outer bypass port member has an inner surface from which a second shoulder portion radially inwardly extends, said inner surface overlying said outer surface with said first shoulder portion facing said second shoulder portion so that a chamber is defined thereby; and said retrievable fluid control valve further comprises shock absorbing means, disposed in said chamber, for absorbing a mechanical shock between said first and second shoulder portions when said bypass mandrel is moved to said open bypass position.

3. The retrievable fluid control valve of claim 2, wherein said bypass mandrel further has a fluid passageway defined therein between said fifth cavity and said outer surface.

4. The retrievable fluid control valve of claim 1, further comprising:

a sealing shoe having a seventh cavity defined therein, said sealing shoe connected to said outer bypass port member so that said seventh cavity communicates with said fifth cavity of said bypass mandrel; and sealing means, mounted on said sealing shoe, for providing a fluid-tight seal.

5. The retrievable fluid control valve of claim 1, further comprising:

a first spacer member disposed in said first spring housing member between said first spring means and said first spring guide member;

a second spacer member disposed in said second spring housing member between said second spring means and said second spring guide member; and a third spacer member disposed in said third spring housing member between said third spring means and said third spring guide member.

* * * * *